United States Patent [19]

Schian et al.

[11] 4,406,090

[45] Sep. 27, 1983

[54] METHODS AND APPARATUS FOR GRINDING SPIRAL TOOL CUTTING EDGES HAVING NON-CIRCUMFERENTIALLY RELIEVED EDGES

[76] Inventors: Richard F. Schian, 10944 Elms Rd., Birch Run, Mich. 48415; William G. Rexius, 270 Kratz Pl., Hemlock, Mich. 48626

[21] Appl. No.: 273,243

[22] Filed: Jun. 12, 1981

[51] Int. Cl.[3] ..... B24B 3/00

[52] U.S. Cl. ..... 51/95 R; 51/219 R; 51/225; 51/236; 51/288; 409/165

[58] Field of Search ..... 51/95 LH, 95 R, 97 R, 51/103 R, 123 R, 124 R, 129, 216 T, 216 H, 217 T, 218 T, 219 R, 219 PC, 220, 225, 232, 236, 238.66, 262, 288; 76/82, 85, 108 T; 269/6, 238, 289 MR, 254 CS, 902; 409/165, 168

[56] References Cited

U.S. PATENT DOCUMENTS

| | | | |
|---|---|---|---|
| 2,047,055 | 7/1936 | Blood | 51/95 R |
| 2,332,510 | 10/1943 | Franzen | 51/225 |
| 2,484,590 | 10/1949 | Rocheleau | 51/225 |
| 2,569,855 | 10/1951 | Hertlein | 51/225 X |
| 2,616,108 | 11/1952 | Luft | 51/236 |
| 3,030,744 | 4/1962 | Mueller | 51/225 |
| 3,330,073 | 7/1967 | Siemsen | 51/232 X |

*Primary Examiner*—James G. Smith
*Assistant Examiner*—Robert P. Olszewski
*Attorney, Agent, or Firm*—Learman & McCulloch

[57] ABSTRACT

A non-circumferentially relieved surface is ground on the spiral cutting edges of an axially elongate tool using a grinding attachment mounted on a tool supporting table for linear movement to the peripheral edge of a grinding wheel having a fixed finger adjacent the revolving grinding wheel edge adapted to engage behind the portion of the cutting edge being ground to guide the rotary and axial travel of the tool relative to the grinding edge. The tool is supported on a centerless support on the attachment and a top roll is pressed down on the tool shank. The attachment and tool are moved manually forwardly on the table in a grinding pass at a speed dictated by the "feel" of the operator, and while moving the attachment and tool axially and manually revolving said roller at a speed dictated by the "feel" of the operator in timed relation to the forward movement of the attachment and tool.

7 Claims, 6 Drawing Figures

METHODS AND APPARATUS FOR GRINDING SPIRAL TOOL CUTTING EDGES HAVING NON-CIRCUMFERENTIALLY RELIEVED EDGES

BACKGROUND OF THE INVENTION

The present invention is especially related to improved methods and apparatus for grinding and sharpening spiral tool cutting edges, and particularly those which do not have a circumferential edge and cannot be driven in rotation by an electric motor or the like as they are presented to the grinding wheel. Various tool supporting attachments have been proposed in the past, most of which are of the type wherein the tool is continuously revolved by a motor driven member as it is moved to the grinding wheel and are exemplified in the following U.S. Pat. Nos. 1,858,235 2,411,972 2,741,074 3,118,260 3,594,961.

The present attachment is similarly mounted on a tool table or slide which moves linearly to the vicinity of the grinding wheel peripheral edge surface, and essentially provides a true hand operated attachment in the sense that the spiral cutting tool is both revolved and fed axially manually during the grinding operation so that the "feel" of the operator's hands, and skill in manipulating the attachment, ensures that optimum cutting edges are ground in a most expeditious and accurate manner. The tool grinder which is used may be the Cincinnati Milling Machine Co. (Cincinnati, Ohio, U.S.A.) No. 2 machine which is described in the company's publication No. M-1951-2, copyrighted in 1963.

A prime object of the invention is to provide a three-point tool support that will allow one hand to comfortably revolve a cutting tool to be ground or sharpened to the desired position and then present its edges to the grinding wheel for grinding via a manually controlled revolution or partial revolution determined by the helical angle of the cutting tool.

A more specific object of the invention is to provide an attachment having a lever pivoted on the centerless support for the spiral cutting tool, the lever mounting a freely rotatable roller above the centerless support which can be manipulated by the thumb of an operator while, with the same hand, he holds a fixed grip and squeezes the lever to control the pressure on the roller as the tool is moved in a grinding pass. Thus, the force with which the roller revolving the tool is held in frictional engagement with the tool is controlled by the tool grinder during the grinding pass.

Another object of the invention is to provide a fast comfortable way in which the hand that controls the fixture, can also manually release the tool or workpiece.

Another specific object of the invention is to provide an attachment which allows the attachment-controlling hand to "feel" the actual grinding of the tool. This permits the operator to determine the proper speed at which the other hand should present the workpiece to the grinding wheel to allow the grinding wheel to spark out and hold precise tolerances on the cutting edges of the tool.

Still another object of the invention is to provide a mechanism of the character described having a pivotally mounted centerless support assembly for the tool which can be optionally locked or released and is useful to permit the operator to pivot the tool downwardly to miss the wheel on either the forward or return passes.

SUMMARY OF THE INVENTION

An attachment, mounted on a tool supporting table slide moving linearly to the vicinity of a grinding wheel peripheral edge surface and a guide finger fixed at the wheel edge surface which is engageable with the spiral cutting edge of the tool just behind the portion of the cutting edge being ground to guide the grinding pass of the tool being ground, and which has a centerless support for the tool in conjunction with a lever-mounted freely rotatable roller above the centerless support manipulatable to have a predetermined frictional engagement with the tool, is moved on the table slide in a grinding pass. While the attachment and tool are moved axially, the roller is manually revolved by the hand of the tool grinder who, at the same time, grasps the roller mounted lever to apply the desired leverage to the tool revolving roller. Other objects and advantages will become apparent with reference to the accompany drawings.

IN THE DRAWINGS

Referring now more particularly to the accompanying drawings, the attachment generally designated A is disclosed as having a base 10 mounted for linear travel on a table 11 toward and away from the vicinity of a continuously revolved grinding wheel W which is mounted for rotation on an axis generally parallel to the axis of a cutting tool T supported by the attachment A in a manner to be presently disclosed.

Figure 2:
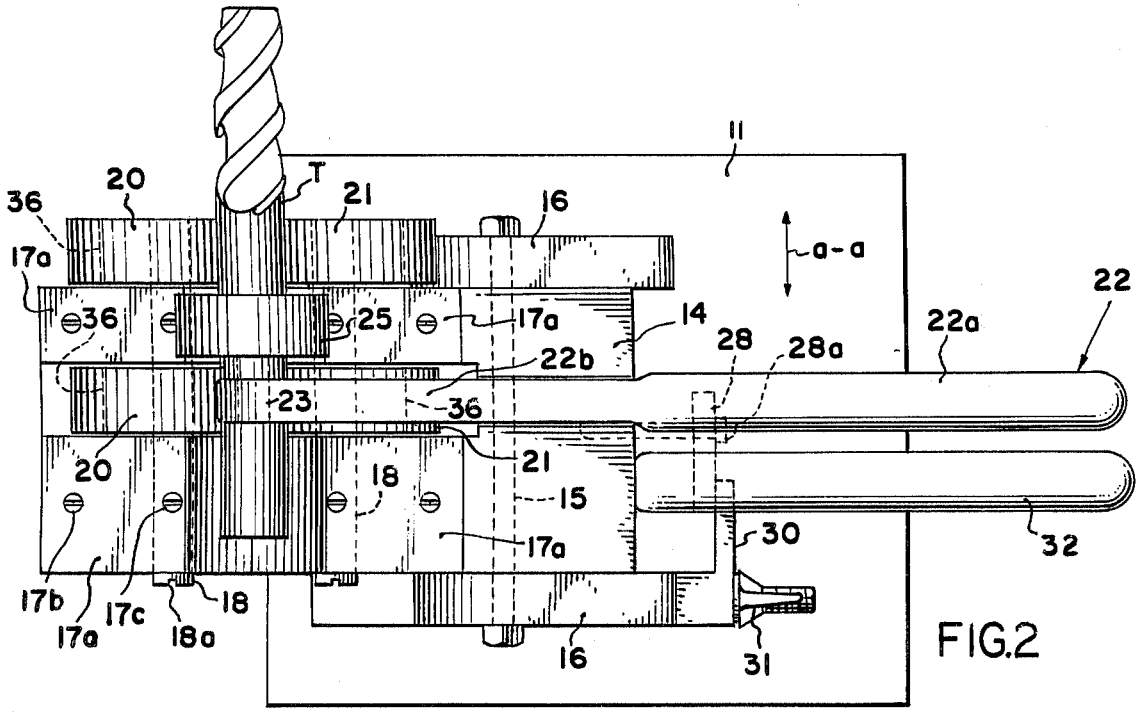
FIG. 2 is a top plan view thereof, with the representation of the hand omitted from the view.
Figure 3:
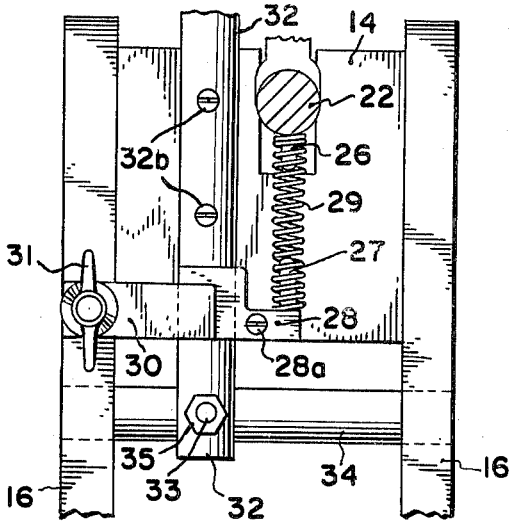
FIG. 3 is a transverse sectional view taken on line 3—3 of FIG. 1.
Figure 4:
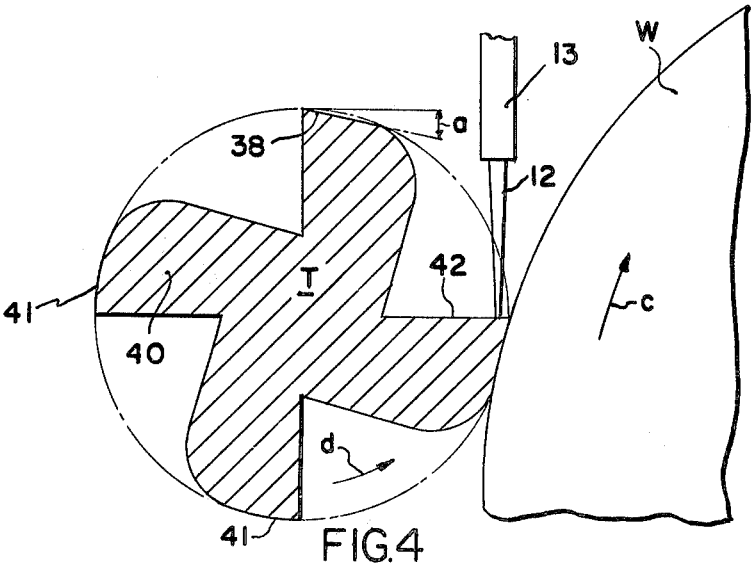
FIG. 4 is a greatly enlarged, cross sectional view of a spiral tool in the process of being ground.
Figure 6:
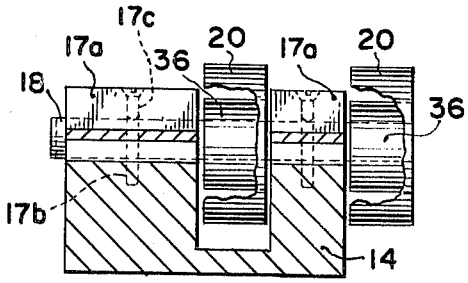
FIG. 6 is a transverse, fragmentary, cross-sectional view taken on the line 6—6 of FIG. 1.

As FIG. 4 indicates, a fixed guide finger 12, rigidly mounted on a sub-frame 13 of the grinding wheel assembly which also supports wheel W for vertical adjustment, is provided at a precise predetermined location. The direction of linear movement of the table slide 11 in the grinding pass is indicated by the arrow a—a in FIG. 2. Provided on base 10 are upright base supports 16 having a pivot shaft 15 on which a recessed centerless tool support block 14 is pivotally secured. The block 14 includes forwardly extending support portions 17, with arbor members 18 which journal pairs of front and rear rollers 20 and 21. These rollers 20 and 21 are eccentrically mounted in a manner to be disclosed to move relatively toward and away from one another to support a tool shank T of particular diameter in proper vertical disposition.

Also mounted on pivot 15 is a pressure applying lever 22, formed with a handle portion **22*a* and a roller mounting portion 22*b*. Freely rotatably mounted on a pin 23 carried by the portion 22*b*, is a roller 25**, which suitably may be made of steel, so as to have some weight which it gravitationally will apply to the tool T on which it rests, when the attachment is in use.

A retaining pin 26, carried on handle portion 22*a*, cooperates with a lower retaining pin 27 carried by a support block 28 fixed as at 28*a* to block 14, to mount a coil spring under compression 29, which continuously urges the handle portion 22*a* upwardly. Block 28 is engaged by a releasable pivotal clamp or keeper 30 which can be positively secured or locked by a thumb screw 31 to the one side frame member 16 in position to overlie member 28 and prevent pivoting of centerless support block 14 about pin 15.

Figure 1:
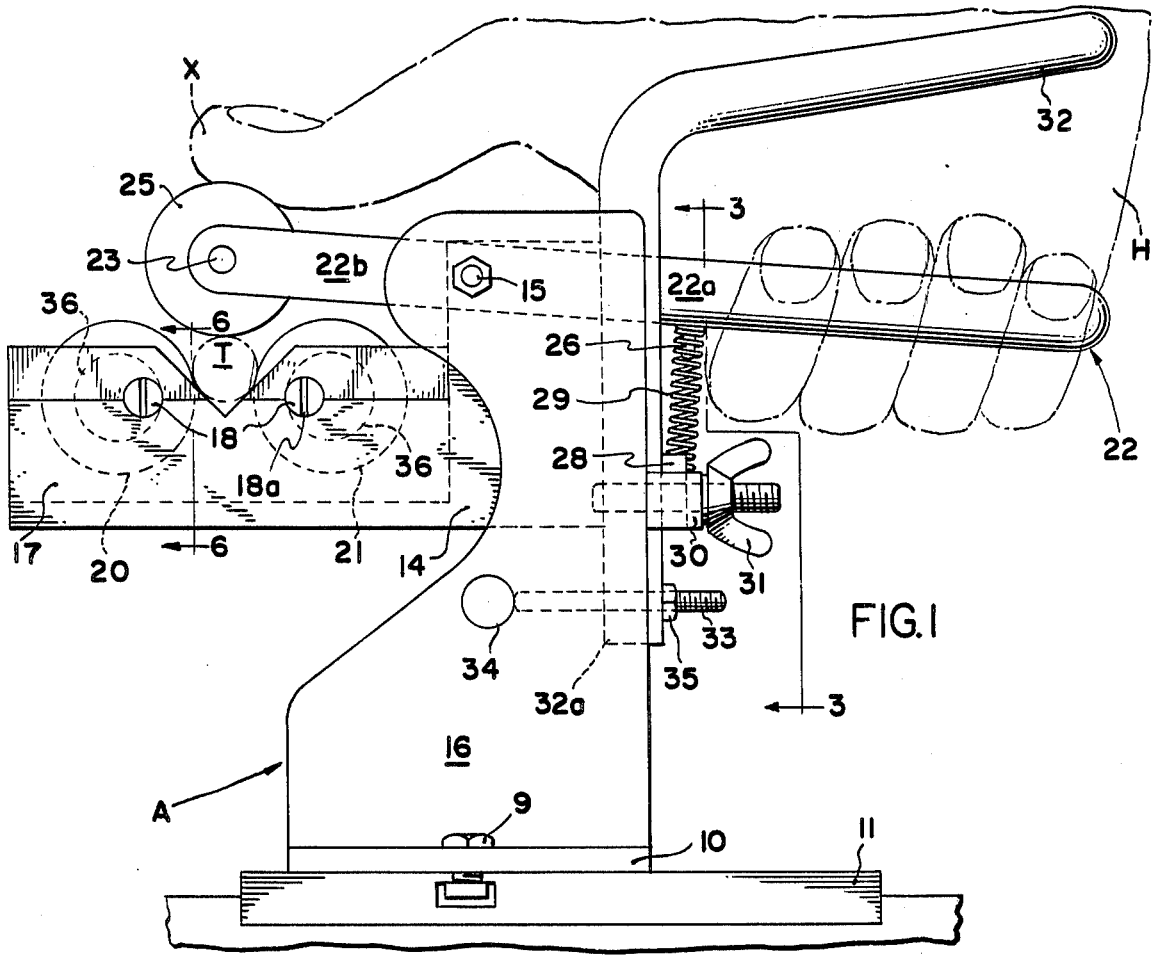
FIG. 1 is a side elevational view showing a spiral tool supported in position and diagrammatically illustrating the manner in which the hand of the tool grinder grips the attachment and revolves the tool during the grinding pass.

At the upper end of the frame, above handle portion 22*a*, is an upwardly angled grip 32 having a downwardly extending mount portion 32*a* which is secured to block 14 by screws 32*b*. A threaded member 33 which abuts a cross piece 34 extending between and connecting the side frame members 16, acts as a stop to limit pivoting of the block 14 upwardly beyond a predetermined position when pivoting of block 14 is permitted, a nut 35 being employed to secure the fixed member 32 in adjusted position laterally adjacent handle portion 22*a*, so that the hand H of the user can grip both fixed member 32 and handle portion 22*a*, while at the same time utilizing thumb X to revolve roller 25 (see FIG. 1).

As indicated, the rollers 20 and 21 are adjustably mounted in a manner which permits them to be relatively spread apart, or moved closer together, dependent on the diameter of the tool T which is being ground. The rollers 20 and 21 are revolvably mounted on eccentrics 36 fixedly carried by the bolts 18, which it will be noted have slots 18*a* provided in their ends for receiving a screw driver. The arbors 18 may be revolved incrementally, which has the effect of revolving the eccentrics 36 on which rollers 20 and 21 are mounted. This action adjusts the relative axial spacing of rolls 20 and 21, while at the same time raising or lowering the level of support of the tool T.

The purpose of the construction is to provide a rigid centerless support for the tool T which permits the tool T to rotate freely, while simultaneously providing a unit which can, with ready adjustment, accommodate a wide range of tools of different diameter. The larger the diameter of the tool T, the more spread-apart will the rollers 20 and 21 be, and the nearer will the axis of the tool T be to the plane connecting the axes of the rollers 20 and 21. Hold-down blocks 17*a* are normally provided for the roller arbors 18 and secured to block 14 as with screws 17*b*. Set screws 17*c* can be used to restrain pivoting of the arbors 18.

Figure 5:
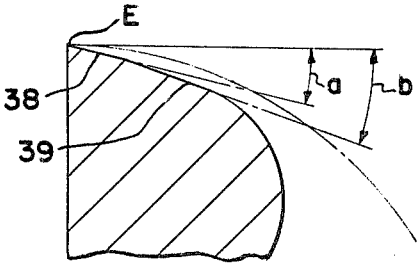
FIG. 5 is a still more enlarged cross sectional view of a portion of a tool bit illustrating non-circumferential relief surfaces which are to be ground thereon.

In FIGS. 4 and 5 we have schematically illustrated the primary and secondary relief surfaces 38 and 39, which are to be ground on the spiral tooth lands 40. With rotation of the griding wheel W in the direction c, and rotation of the tool T in the direction d, the first step in the operation is to grind the surface 38 on a tool land which initially is presented to the grinding wheel W with an unground, or a dulled surface such as is illustrated at 41. The surface 38, which extends at a primary relief angle a, is first of all ground on all land surfaces 40 in consecutive passes and, thereafter, in a subsequent grinding operation and after adjustment of the angle at which the land surfaces 40 are presented to the grinding wheel, the surfaces 39 are ground on the lands 40 at the secondary relief angle b. Typically, the primary relief angle may be 12° and the secondary relief angle 18°, and the secondary relief angle may be ground by raising the guide finger 12 and the axis of wheel W in order to change the center-line relationship of the tool T to the wheel.

In operation, it is to be understood that the table 10 is moved toward and away from the grinding wheel along path a—a by a hand operated crank wheel which occupies one hand of the grinding machine operator. With the other hand, the operator grips the attachment in the manner indicated in FIG. 1 with his thumb X engaging and revolving the wheel 25 as the table 11 is moved along the linear path a—a to the grinding wheel W.

The attachment A can be secured by a T-bolt 9 to the table 11 parallel to the direction of linear travel of table 11, to obtain the required relief angle as the manually revolved tool T is guided past the periphery of the wheel. At the time the front end of tool T nears the peripheral face of the wheel W, the guide finger 12 is received between lands 40 upon the front surface 42 of each land 40 and functions to guide the tool T in its spiral path. In FIG. 4 the wheel W is shown removing material at the angle a to provide the primary relief angle for cutting edge E. The operator may opt to grind in a forward pass, and then pivot the roller support 14 about pin 15 so that the tool T can be withdrawn by moving table 11 in the reverse direction, without the tool T coming into contract with grinding wheel W.

During the grinding pass, the "feel" of the operator is extremely important in terms of the speed of rotation of wheel 25 which must correlate with the movement of table 11. The spring 29 functions only as an assist and it is the squeezing of the hand, with the operator grasping both handle portions 32 and 22*a*, which determines the amount of pressure exerted while thumb X is revolving the wheel 25 as the spiral tool is longitudinally fed in its spiral path past the grinding wheel W.

The operator will first set up the attachment to grind surfaces 38 at the primary relief angle a on the cutting edges E of a plurality of tools; thereafter he will adjust the wheel W and finger 13 upwardly to finish the grinding operation upon these tools by then, in successive passes grinding surfaces 39 at the secondary relief angle b on the tool lands 40.

If it is desired to perform the grinding operation on the return portion of the stroke, the operator can pivot the tool support 14 downwardly about pivot pin 15, and miss the grinding wheel on the forward pass of table 11. This positions the tool rearwardly of wheel W in a position such that the grinding operation can be performed on the withdrawal stroke of table 11.

It is important that the tool support 14 be pivoted at the upper end of the device so that the tool support assembly pivots along a downward arc which moves away from the wheel W. In order for both the lever 22 and the angled portions of grip 32 to be gripped in one hand in the manner depicted in FIG. 1, they must be mounted sufficiently in vertically juxtaposed position.

To change tools the operator with his hand on grip 32 needs only to move his finger to the top of handle portion 22*a* and exert a spreading force while removing the tool with the other hand and inserting the next tool to be sharpened.

To pivot assembly 14 downwardly to "miss" the grinding wheel, thumb screw 31 can be loosened enough to permit the operator to rotate keeper 30 sufficiently to release plate 28.

While one embodiment of the invention has been described in detail, it will be apparent to those skilled in the art that the disclosed embodiment may be modified. Therefore, the foregoing description in all aspects is to be considered exemplary rather than limiting in any way, and the true scope of the invention is that defined in the following claims.

What is claimed is:

1. In a grinder attachment for assisting a tool grinder to grind a spiral tool cutting edge having a non-circumferentially relieved land surface; the attachment being mounted on a tool table slide mounted for movement linearly to the vicinity of a grinding wheel peripheral edge surface and there being a guide finger fixed at the wheel edge surface which is engageable with the cutting edge just behind the portion of the edge being ground to guide the rotary and linear travel of the tool being ground relative to the grinding wheel; said attachment including a base supported on the table slide so that the attachment moves in a linear path with said table slide to the grinding wheel; a non-driven centerless support on said base on which a tool is supported with its axis generally parallel to the table slide; a lever member pivoted to swing about an axis on the centerless support and mounting a freely rotatable roller movable in a path with swinging of the lever to engage the shank of a tool resting on said support; the lever member having a handle on the opposite side of the axis from the roller; and a grip on said attachment separate from but adjacent said lever handle in juxtaposted position with it so that it can be gripped with the same hand which holds said lever to "feel" and gauge the force with which the roller is frictionally held down on the tool shank while the thumb of the hand rotates the roller to feed the edge in a spiral path as the attachment moves forward on the table to grind the spiral edge.

2. The system defined in claim 1 in which spring means normally urges said lever to pivot in a direction to press the roller down on the tool shank in a direction toward said centerless support and said grip is positioned above the handle of the lever member so that this spring pressure is augmented when the hand squeezes the lever handle and grip.

3. The system of claim 2 wherein the grip comprises a handle protruding beyond the base adjacent said lever handle.

4. The system of claim 1 in which said centerless support comprises rollers supported in parallel juxtaposition.

5. The system of claim 4 in which said centerless support is pivoted on the same pivot as the lever member and lock means is provided for releasably preventing said centerless support from pivoting.

6. The system of claim 4 in which adjustable eccentric means mounts said rollers, which can be adjusted to vary the spacing between said rollers, and means for locking the rollers in adjusted position.

7. A method for grinding a spiral cutting edge having a non-circumferentially relieved surface on an axially elongate tool having a shank at one end using a grinding attachment mounted on a tool supporting table for linear movement to the peripheral edge of a grinding wheel having a fixed finger adjacent the revolving grinding wheel edge adapted to engage behind the portion of the cutting edge being ground to guide the rotary and axial travel of the tool relative to the grinding edge, and wherein the tool is supported on a centerless support on the attachment and a top roller is supported on a pivoted lever in position to be pressed down on the tool shank; the step of manually moving the attachment and tool forwardly on the table in a grinding pass at a speed dictated by the "feel" of the operator; and while moving the attachment and tool axially, manually levering the roller toward the tool while manually directly revolving said roller at a speed dictated by the "feel" of the operator in timed relation to the forward movement of the attachment and tool.

* * * * *